US006326928B1

(12) United States Patent
Kitamura et al.

(10) Patent No.: US 6,326,928 B1
(45) Date of Patent: Dec. 4, 2001

(54) ANTENNA FIXING METHOD AND DEVICE

(75) Inventors: Toshiyasu Kitamura, Kanagawa; Hiroyuki Chihara, Tokyo; Nobutoshi Hamada; Hideo Ono, both of Kanagawa, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/695,888

(22) Filed: Oct. 25, 2000

(30) Foreign Application Priority Data

Oct. 26, 1999 (JP) ..... P11-304601

(51) Int. Cl.[7] ..... H01R 1/24
(52) U.S. Cl. ..... 343/702; 343/900; 343/901
(58) Field of Search ..... 343/702, 715, 343/900, 901, 906; H01R 1/24, 1/36

(56) References Cited

U.S. PATENT DOCUMENTS 5,177,492 * 1/1993 Tomura et al. ..... 343/702
5,757,325 * 5/1998 Saldell ..... 343/702
5,917,453 * 6/1999 Uchino et al. ..... 343/721
6,052,089 * 4/2000 Eggleston ..... 343/702
6,075,487 * 6/2000 Ito ..... 343/702
6,147,661 * 11/2000 Nakagawa et al. ..... 343/895
6,163,300 * 12/2000 Ishikawa et al. ..... 343/702
6,198,448 * 3/2001 Suzuki et al. ..... 343/725

* cited by examiner

*Primary Examiner*—Tho Phan
(74) *Attorney, Agent, or Firm*—Pearne & Gordon LLP

(57) ABSTRACT

An external thread portion of an antenna holder (12), mounted on an antenna body (11), is connected to an internal thread portion of an antenna holder-receiving member (15) provided on an antenna guide (18), and in this connected condition, an antenna is passed through an antenna body passage hole (17) formed in a casing (13). Then, a fastening member (19) is mounted in a fitting portion (20), which is formed in the casing (13) so as to fix the antenna, and is disposed in the vicinity of the antenna body passage hole (17), thereby fixing the antenna. Therefore, the antenna can be mounted and fixed without using much labor and time.

6 Claims, 3 Drawing Sheets

PRIOR ART

ANTENNA FIXING METHOD AND DEVICE

BACKGROUND OF THE INVENTION

This invention relates to an antenna fixing method and an antenna fixing device, and more particularly to a construction in which an external thread portion of an antenna holder is connected to an internal thread portion of an antenna holder-receiving member provided on an antenna guide, and in this condition the antenna is mounted on and fixed to a casing, and after the fixing, the antenna can be removed from a body box member by disconnecting the antenna holder from the antenna holder-receiving member by loosing the threads.

A portable terminal equipment, such as a portable cellular telephone and a PHS (Personal Handyphone System), is equipped with an antenna. For mounting this antenna on the portable terminal equipment, a first step is to beforehand fix an antenna holder-receiving member to a body box member. A second step is to insert an antenna body, having an antenna holder integrally connected thereto, into the antenna holder-receiving member. A third step is to screw and connect the antenna holder to an internal thread portion of the antenna holder-receiving member. Thus, this mounting operation is carried out by the three steps.

However, in the above operation, the assembling operation is effected on the body box member, and the operation for inserting the antenna body into the antenna holder-receiving member and the operation for threadedly connecting the antenna holder to the antenna holder-receiving member are not suited for an automated operation, and therefore there has been encountered a problem that the time, required for assembling the portable cellular telephone, can not be reduced.

FIG. 4 is an exploded, perspective view explanatory of a conventional antenna mounting-fixing method. In FIG. 4, in an assembling operation, first, an antenna holder-receiving member 5, having an antenna guide 8 and an antenna terminal 6 connected thereto, is received in a predetermined position in a lower casing 3. In FIG. 4, for showing the assembled condition, although the antenna holder-receiving member 5 is shown as slightly floating relative to the lower casing 3, the antenna holder-receiving member 5 is finally held in intimate contact with the lower casing 3, so that a hole in the antenna holder-receiving member 5 communicates with an antenna body passage hole 7. Thereafter, an upper casing 9 is attached, and the antenna holder-receiving member is held between the lower casing 3 and the upper casing 9, thereby fixing it.

On the other hand, outside the lower casing 3, there is prepared an antenna body 1 passing through an antenna holder 2, and this is introduced into the antenna body passage hole 7, and is guided to the antenna holder-receiving member 5 mounted within the lower casing 3.

Thereafter, an external thread portion, formed on the antenna holder 2, is connected to an internal thread portion, formed on the antenna holder-receiving member 5, through a washer 4. By dosing so, the antenna is mounted and fixed.

However, when the antenna body 1 is bent or broken from some cause while the user uses the portable cellular telephone, the antenna body 1 need to be exchanged. In order to simplify the exchanging operation as much as possible, there has been used, as a method of exchanging the antenna body 1, a standard exchanging method in which the antenna holder 2 is rotated by the use of a special tool so as to loosen the threads, and the antenna body 1, together with the antenna holder 2, is disconnected from the antenna holder-receiving member 5, and a new antenna body 1, having an antenna holder 2 attached thereto, is passed through the antenna holder-receiving member 5, and the antenna holder 2 is rotated to be threadedly connected to the antenna holder-receiving member 5, thereby effecting the mounting operation. This exchanging operation method has already been substantially a standard operation method in the industry, and there has been encountered a problem that it is difficult to change the above conventional structure.

SUMMARY OF THE INVENTION

This invention seeks to solve the above problem of the conventional art, and an object of the invention is to provide an antenna fixing method and an antenna fixing device, in which an external thread portion of an antenna holder is connected to an internal thread portion of an antenna holder-receiving member provided on an antenna guide, and in this connected condition, the antenna can be mounted on and fixed to a casing.

According to the first aspect of the invention, there is provided an antenna fixing method wherein an external thread portion of an antenna holder, mounted on an antenna body, is beforehand connected to an internal thread portion of an antenna holder-receiving member provided on an antenna guide; and in this connected condition, an antenna is passed through an antenna body passage hole formed in a casing; and a fastening member is mounted in a fitting portion, which is formed in the casing so as to fix the antenna, and is disposed in the vicinity of the antenna body passage hole, thereby fixing the antenna.

With this construction, the antenna, having the antenna holder, and the antenna holder-receiving member can be incorporated in an integrally-connected posture into a body box member, and therefore the mounting and fixing can be carried out without using much labor and time.

According to the second aspect of the invention, there is provided an antenna fixing device wherein the device comprises an antenna holder mounted on an antenna body, an antenna holder-receiving member provided on an antenna guide, a casing having an antenna body passage hole and a fitting portion which is provided in the vicinity of the antenna body passage hole so as to receive a fastening member, and the fastening member for fixing an antenna; and an external thread portion of the antenna holder is beforehand connected to an internal thread portion of the antenna holder-receiving member, and in this connected condition, the antenna is passed through the antenna body passage hole, and the fastening member is mounted in the fitting portion, thereby fixing the antenna.

With this construction, the antenna, having the antenna holder, and the antenna holder-receiving member can be incorporated in an integrally-connected posture into the body box member, and therefore the mounting and fixing can be carried out without using much labor and time.

The third aspect of the invention is directed to an antenna fixing device according to the second aspect of the invention, wherein the fastening member has an antenna terminal.

With this construction, the mounting and fixing can be carried out without using much labor and time, and besides this can be used also as the antenna terminal.

The fourth aspect of the invention is directed to an antenna fixing device according to the second aspect of the invention, wherein a washer is interposed between the antenna holder and the antenna holder-receiving member, and also a washer is interposed between the antenna holder-receiving member and the antenna body passage hole.

With this construction, the mounting and fixing can be positively carried out without using much labor and time.

The fifth aspect of the invention is directed to an antenna fixing device according to the fourth aspect of the invention, wherein the washers are composed of silicone rubber.

With this construction, the mounting and fixing can be positively carried out without using much labor and time.

The sixth aspect of the invention of is directed to a portable terminal equipment wherein an antenna is fixed by an antenna fixing device as defined in the second, third, fourth and fifth aspect of the invention.

The mounting and fixing of the antenna can be carried out without using much labor and time, and therefore the portable terminal equipment can be provided at a lower cost.

DERAILED DESCRIPTION OF THE PREFERRED EMBODIMENT

An embodiment of the present invention will now be described with reference to FIGS. 1 to 3.

Figure 1:
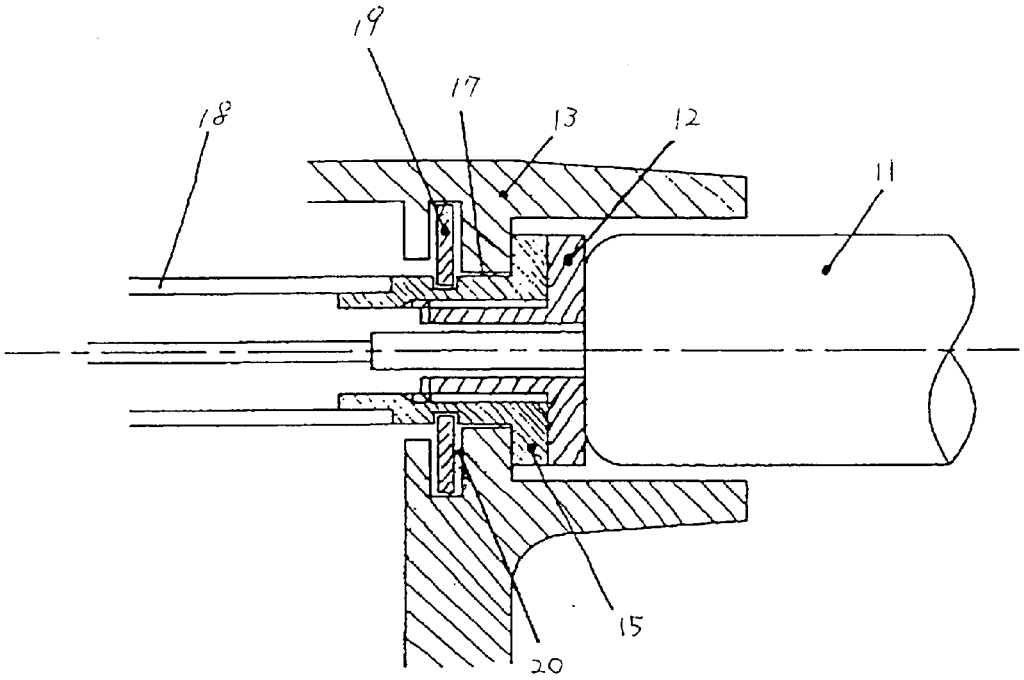
FIG. 1 sa cross-sectional view showing the construction of an embodiment of an antenna fixing device of the present invention.

FIG. 1 is a cross-sectional view showing the construction of an embodiment of an antenna fixing device of the present invention.

FIG. 2 is cross-sectional views sequentially showing the steps of a process of mounting and fixing an antenna relative to a lower casing 13 in the embodiment of FIG. 1. FIG. 2A shows a condition in which the lower casing 13 and an antenna body 11 are still separate from each other. In FIG. 2A, the lower casing 13 has an antenna body passage hole 17, and a fitting portion 20 which is disposed in the vicinity of the antenna body passage hole 17, and a fastening member 19 for fixing the antenna is adapted to be mounted in this fitting portion 20.

On the other hand, with respect to the antenna body, an external thread portion of an antenna holder 12 is connected to an internal thread portion of an antenna holder-receiving member 15, provided on an antenna guide 18, thereby providing an integrally-connected construction as the antenna.

Figure 2A:
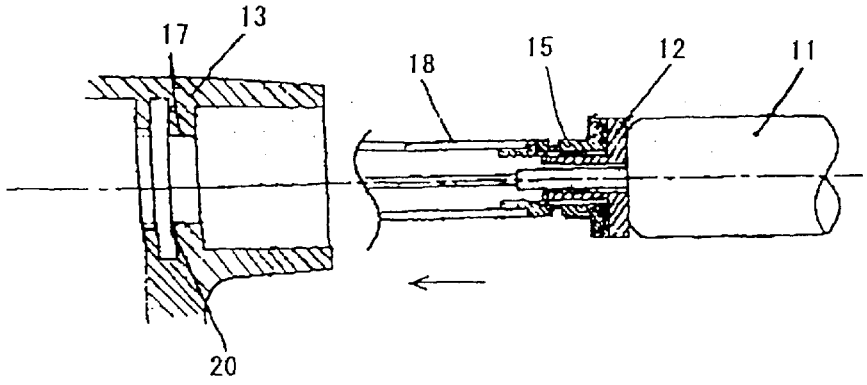
FIG. 2 is cross-sectional views showing a process of mounting and fixing an antenna in the embodiment of the invention, as well as a process of removing the antenna for exchanging purposes.
Figure 2B:
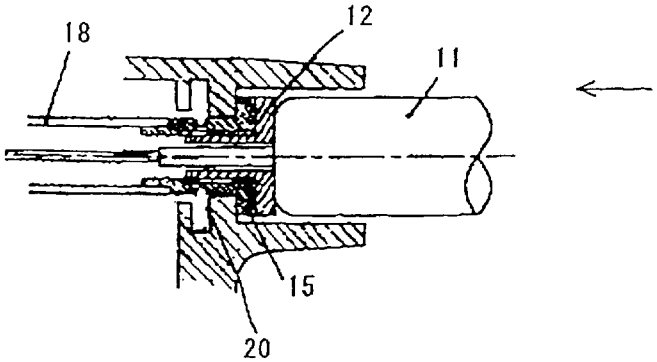

Then, in this condition in which the external thread portion of the antenna holder 12, mounted on the antenna body 11, is connected to the internal thread portion of the antenna holder-receiving member 15 provided on the antenna guide 18, the antenna is passed through the antenna body passage hole 17 formed in the lower casing 13, as shown in FIG. 2B.

Figure 2C:
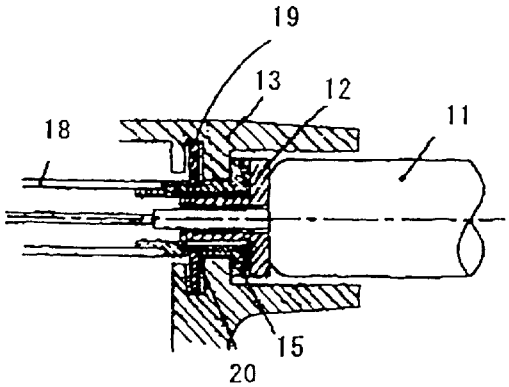

Then, as shown in FIG. 2C, the fastening member 19 for fixing the antenna is mounted in the fitting portion 20, which is formed in the lower casing 13, and is disposed in the vicinity of the antenna body passage hole 17, thereby fixing the antenna. Therefore, the mounting and fixing of the antenna can be effected without using much labor and time.

Figure 2D:
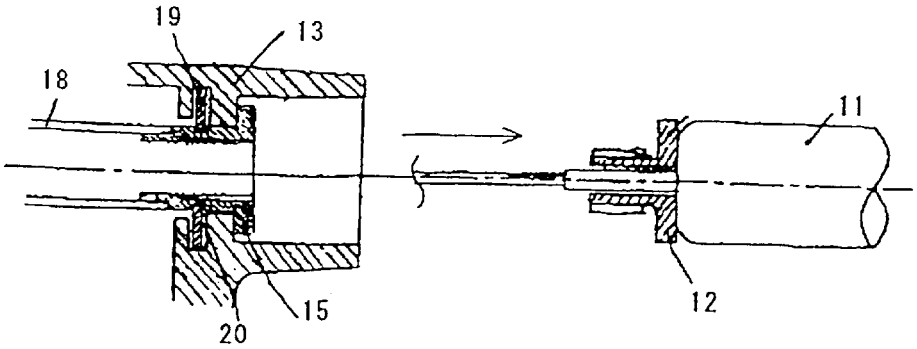
Figure 4:
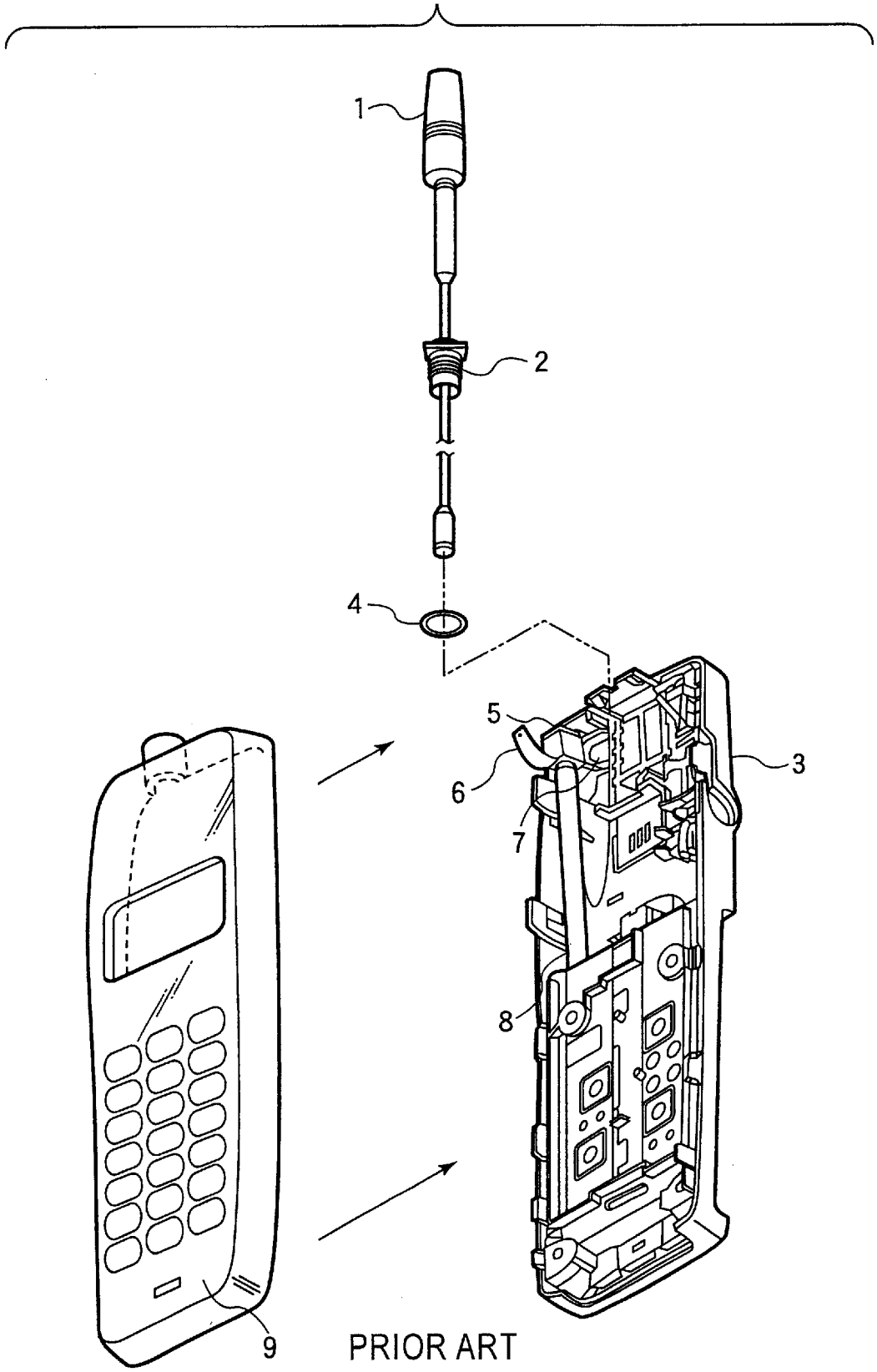
FIG. 4 is an exploded, perspective view explanatory of a conventional antenna mounting-fixing method.

With respect to a method of exchanging the antenna body 11 after the fixing operation is effected according to the above procedure, there can be used a conventional exchanging method in which the antenna holder 12 is rotated by a special tool so as to loosen the threads threadedly connected to the antenna holder-receiving member 15, and the antenna body 11, together with the antenna holder 12, is disconnected from the antenna holder-receiving member 15, and a new antenna body 11 is mounted, as shown in FIG. 2D.

Figure 3:
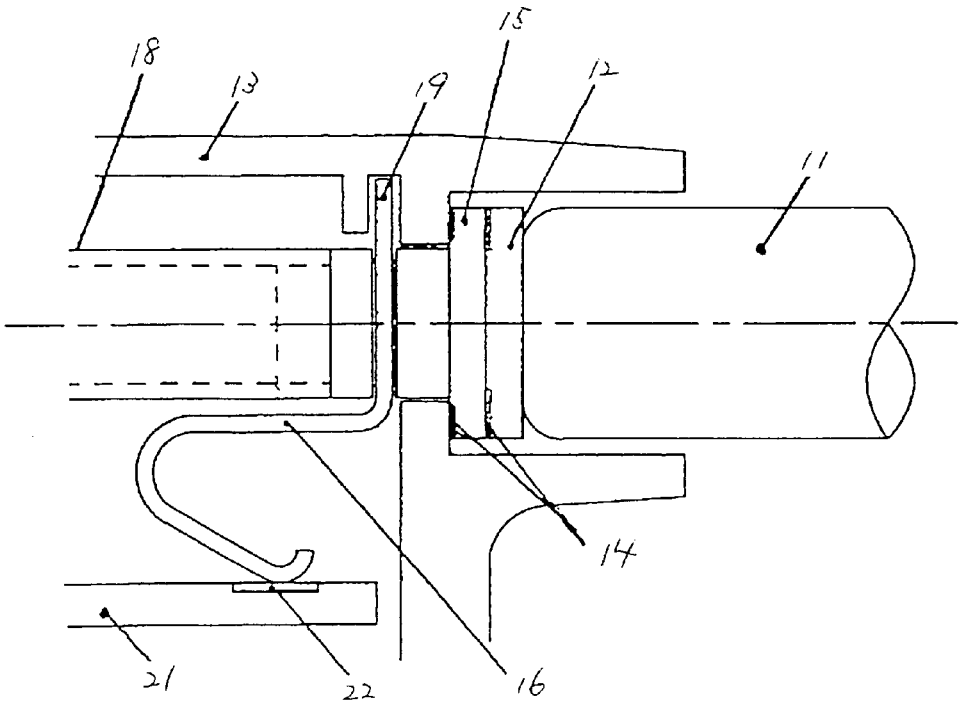
FIG. 3 is a top plan view showing the construction of the antenna fixing device embodying the present invention.

FIG. 3 is a top plan view showing the construction of the antenna fixing device embodying the present invention. In FIG. 3, an antenna terminal 16 is mounted on the fastening member 19 to provide a set, and when the fastening member 19 is mounted, the antenna can be fixed, and also the antenna terminal 16 can be contacted with a land 22 formed on a printed circuit board 21.

In FIG. 3, a washer 14 is interposed between the antenna holder 12 and the antenna holder-receiving member 15, and also a washer 14 is interposed between the antenna holder-receiving member 15 and the antenna body passage hole. Therefore, the fastening can be effected firmly, and moisture and the like can be prevented from intruding into the interior of the box member. Silicone rubber can be used to form the washers 14.

As described above, the first aspect of the invention is directed to the antenna fixing method wherein the external thread portion of the antenna holder, mounted on the antenna body, is beforehand connected to the internal thread portion of the antenna holder-receiving member provided on the antenna guide, and in this connected condition, the antenna is passed through the antenna body passage hole formed in the casing, and the fastening member is mounted in the fitting portion, which is formed in the casing so as to fix the antenna, and is disposed in the vicinity of the antenna body passage hole, thereby fixing the antenna. With this construction, the antenna, having the antenna holder, and the antenna holder-receiving member can be incorporated in an integrally-connected posture into the body box member, and therefore there is achieved an advantageous effect that the mounting and fixing can be carried out without using much labor and time. Another advantageous effect is that for exchanging the antenna, there can be used a conventional exchanging method in which the antenna holder is rotated by the special tool so as to loosen the threads threadedly connected to the antenna holder-receiving member, and the antenna body, together with the antenna holder, is disconnected from the antenna holder-receiving member, and a new antenna body is mounted.

The second aspect of the invention is directed to the antenna fixing device characterized in that the device comprises the antenna holder mounted on the antenna body, the antenna holder-receiving member provided on the antenna guide, the casing having the antenna body passage hole and the fitting portion which is provided in the vicinity of the antenna body passage hole so as to receive the fastening member, and the fastening member for fixing an antenna, and the external thread portion of the antenna holder is beforehand connected to the internal thread portion of the antenna holder-receiving member, and in this connected condition, the antenna is passed through the antenna body passage hole, and the fastening member is mounted in the fitting portion, thereby fixing the antenna. With this construction, the antenna, having the antenna holder, and the antenna holder-receiving member can be incorporated in an integrally-connected posture into the body box member, and therefore there is achieved an advantageous effect that the mounting and fixing can be carried out without using much labor and time.

The third aspect of the invention is directed to the antenna fixing device according to the second aspect of the invention, wherein the fastening member has the antenna terminal. With this construction, there are achieved advantageous effects that the mounting and fixing can be carried out without using much labor and time, and that this can be used also as the antenna terminal.

The fourth aspect of the invention is directed to the antenna fixing device according to the second aspect of the invention, wherein the washer is interposed between the antenna holder and the antenna holder-receiving member, and also the washer is interposed between the antenna holder-receiving member and the antenna body passage hole. With this construction, there is achieved an advantageous effect that the mounting and fixing can be positively carried out without using much labor and time.

The fifth aspect of the invention is directed to the antenna fixing device according to the fourth aspect of the invention, wherein the washers are composed of silicone rubber. With this construction, there is achieved an advantageous effect that the mounting and fixing can be positively carried out without using much labor and time.

The sixth aspect of the invention is directed to a portable terminal equipment wherein an antenna is fixed by the antenna fixing device as defined in second, third, fourth and fifth aspect of the invention. The mounting and fixing of the antenna can be carried out without using much labor and time, and therefore there is achieved an advantageous effect that the portable terminal equipment can be provided at a lower cost.

What is claimed is:

1. An antenna fixing method comprising the steps of:

beforehand connecting an external thread portion of an antenna holder mounted on an antenna body to an internal thread portion of an antenna holder-receiving member provided on an antenna guide;

passing an antenna mounted to the antenna body through an antenna body passage hole formed in a casing; and mounting a fastening member in a fitting portion formed in the casing so as to fix the antenna, the fitting portion being disposed in the vicinity of the antenna body passage hole.

2. A portable terminal device comprising:

an antenna holder mounted on an antenna body, the antenna holder having an external thread portion;

an antenna holder-receiving member provided on an antenna guide, the antenna holder-receiving member having an internal thread portion;

a casing having an antenna body passage hole and a fitting portion which is provided in the vicinity of the antenna body passage hole; and a fastening member for fixing an antenna and fitted in the fitting portion, wherein the external thread portion of said antenna holder is beforehand connected to an internal thread portion of said antenna holder-receiving member, and in this connected condition, the antenna is passed through the antenna body passage hole, and the fastening member is mounted in the fitting portion, thereby fixing the antenna.

3. An antenna fixing device according to claim 2, wherein the fastening member includes an antenna terminal.

4. An antenna Fixing device according to claim 2, further comprising:

a first washer interposed between said antenna holder and said antenna holder-receiving member; and a second washer interposed between said antenna holder-receiving member and said antenna body passage hole.

5. An antenna fixing device according to claim 4, wherein the washers are composed of silicone rubber.

6. A portable terminal device comprising:

an antenna is fixed by an antenna fixing device including:

an antenna holder mounted on an antenna body, the antenna holder having an external thread portion;

an antenna holder-receiving member provided on an antenna guide, the antenna holder-receiving member having an internal thread portion;

a casing having an antenna body passage hole and a fitting portion which is provided in the vicinity of the antenna body passage hole; and a fastening member for fixing an antenna and fitted in the fitting portion, wherein the external thread portion of said antenna holder is beforehand connected to an internal thread portion of said antenna holder-receiving member, and in this connected condition, the antenna is passed through the antenna body passage hole, and the fastening member is mounted in the fitting portion, thereby fixing the antenna.

* * * * *

UNITED STATES PATENT AND TRADEMARK OFFICE

CERTIFICATE OF CORRECTION

PATENT NO. : 6,326,928 B1
DATED : December 4, 2001
INVENTOR(S) : Toshiyasu Kitamura et al.

It is certified that error appears in the above-identified patent and that said Letters Patent is hereby corrected as shown below:

Column 3,
Line 18, please delete "sa" and insert therefor -- is a --; and

Column 6,
Line 18, please delete "Fixing" and insert therefor -- fixing --.

Signed and Sealed this

Seventh Day of May, 2002

*Attest:*

*Attesting Officer*

JAMES E. ROGAN
*Director of the United States Patent and Trademark Office*